US005898274A

United States Patent [19]

Ferrero

[11] Patent Number: 5,898,274

[45] Date of Patent: Apr. 27, 1999

[54] INTEGRATED STARTER AND REGULATOR FOR FLUORESCENT TUBES

[76] Inventor: Alexandre Ferrero, Rue Basse Les Hauts de la Trinité, 06340 La Trinite, France

[21] Appl. No.: 08/894,590

[22] PCT Filed: Feb. 21, 1996

[86] PCT No.: PCT/FR96/00271

§ 371 Date: Aug. 22, 1997

§ 102(e) Date: Aug. 22, 1997

[87] PCT Pub. No.: WO96/26628

PCT Pub. Date: Aug. 29, 1996

[30] Foreign Application Priority Data

Feb. 23, 1995 [FR] France ..... 95 02445

[51] Int. Cl.[6] ..... H05B 37/00

[52] U.S. Cl. ..... 315/DIG. 5; 315/189; 313/234; 313/607

[58] Field of Search ..... 313/234, 607, 313/491; 315/260, 261, 263, 264, 189, 56, 58, 59, 60, 71, 72, 73–75, 94, 101, 105, 106, 107, DIG. 5; 525/331.5; 528/310, 322, 392

[56] References Cited

U.S. PATENT DOCUMENTS

| | | | |
|---|---|---|---|
| 4,092,562 | 5/1978 | Campbell | 315/189 |
| 4,415,837 | 11/1983 | Sodini | 315/177 |

FOREIGN PATENT DOCUMENTS

| | | |
|---|---|---|
| 5-74587 | 3/1993 | Japan . |
| WO 93/04478 | 3/1993 | WIPO . |

*Primary Examiner*—Don Wong
*Assistant Examiner*—David H. Vu
*Attorney, Agent, or Firm*—Young & Thompson

[57] ABSTRACT

A control and starting device for fluorescent tubes powered by an electrical circuit via two electrodes, the device includes a loaded polymer part provided adjacent to the tube and used as a ballast providing starting and proper operation control functions for the tube.

17 Claims, 3 Drawing Sheets

INTEGRATED STARTER AND REGULATOR FOR FLUORESCENT TUBES

BACKGROUND OF THE INVENTION

The present invention relates to an electrical lighting device comprising a tube containing an ionizable gas.

DESCRIPTION OF THE RELATED ART

Systems for starting and regulating gas discharge tubes, such as fluorescent tubes, are generally comprised of transformers and ballasts with a winding and magnetic cores having high magnetic losses, series inductances, starters or heated filaments to permit starting the tubes and regulating their intensity.

They can also comprise heating filaments and resistances or again using high-frequency electronic ballasts, voltage multipliers to permit starting. These elements have various drawbacks such as weight and the relatively large size of the lighting stabilization circuits, heat generation of the self-systems, parasitage and pollution of the current lines.

Such systems are often heavy and cumbersome, thereby limiting the possibilities of the lighting designer.

French patent application 87 07146 discloses a continuous voltage doubling device, adapted to the ends of the tube and permitting starting without a ballast or a starter.

French patent application 89 04356 discloses a voltage doubling device provided with a switch reversing the polarity of the voltage at the terminals of the tube so as to avoid dissymmetry of operation, which causes premature darkening of the tube.

The state of the art can also be defined by U.S. Pat. No. 4,092,562, which relates to a lamp comprising a fluorescent tube, a load resistance, starting means and terminal connections to connect a plurality of lamps together.

This system, although less cumbersome, still utilizes on the one hand a load resistance and on the other hand starter means. No element combining these two functions is used, which would permit further decreasing the costs of fabrication and the size of the lamp thus equipped.

SUMMARY OF THE INVENTION

The present invention has for its object a device combining the functions of assisting with starting and regulation of the gas tubes, being of small size and reduced weight, permitting freer design of lighting and protective lighting systems comprising a fluorescent tube and an integrated system to help with starting and regulation.

This lighting device according to the invention is particularly remarkable in that it uses characteristics of resistivity and adaptability of production of loaded polymers.

To this end, the present invention provides a device to help in starting and regulation of fluorescent tubes, such as a gas discharge tube supplied by two electrodes from an electric circuit, each electrode being located at one of the ends of the tube, characterized by the fact that the electric circuit comprises a member of loaded polymer, this member being located adjacent the tube, and that said member of loaded polymer serves as a ballast for the tube with the functions of assisting starting and regulation of the correct operation of said tube.

At least one of the electrodes is coupled with a condenser and a diode-resistance assembly having for its operation to more easily start the discharge and the adjustment of the brilliance of the tube by means of the loaded polymer.

According to a first embodiment, the loaded polymer is constituted of polyvinyl chloride and/or nylon with inclusions of metal and/or carbon black.

According to a second embodiment, the loaded polymer is constituted by polymers such as ionized polyacetylene.

The ions used are constituted by sodium, iodine and/or mercury.

The member of loaded polymer constitutes a frame serving as a support and reflector for the tube.

Other characteristics and advantages of the invention will become apparent from the description which follows, given by way of non-limiting example and with reference to the drawings.

DESCRIPTION OF THE PREFERRED EMBODIMENT

The structure of the member 4 of loaded polymer can be of different natures.

The production of polyvinyl chloride or nylon loaded by the inclusion of powders, metallic fibers, or carbon black, permits the production of heating resistances and light structures conducting electrostatic charges. These products are known and standardized as extrinsic polymeric conductors.

Also known are doped polymers, intrinsically conductors because of the fact of the modification of the molecule by chemical or electrical inclusion of radicals. It has also been shown that by doping certain polymers such as polyacetylene with ions (sodium, iodine or mercury), their conductivity can reach values near that of metals.

According to the invention, the use of the characteristics of resistivity of the loaded polymers 4 permit substituting this product for ballasts used to regulate the operation of fluorescent tubes, while avoiding the use of a complex device as a starter.

Numerous advantages result from the physical characteristics of the product which, by the effect of resistance but also by the electrostatic effect, permit starting the fluorescent tube 1 and, by the Joule effect, permit maintaining it at the temperature required for optimum brilliance, which can have an interest according to the temperatures of utilization (40° C. of cold point).

The invention limits disturbance or parasitage of the electrical grid lines during fluorescent tube operation.

The present invention also offers the advantage of operation of the device no matter what the frequency of the grid to which it is connected. The products produced according to the invention can also be provided in countries at which said frequencies are different.

It is to be noted that the higher the frequency, the less apparent is the stroboscopic effect.

Moreover, the device including no high magnetic loss transformer, the power factor of the assembly constituted by the tube and its starting circuit is very favorable, except when a capacitance is used.

Beyond these technical advantages, the starting device of fluorescent tube 1 according to the invention permits substantial improvements not only as to fabrication but also as to the sale of lighting sources.

The characteristics of weight, size, modularity of mounting, sealing, fireproofness of the produced products according to the invention are some of the advantages offered to users.

Figure 1:
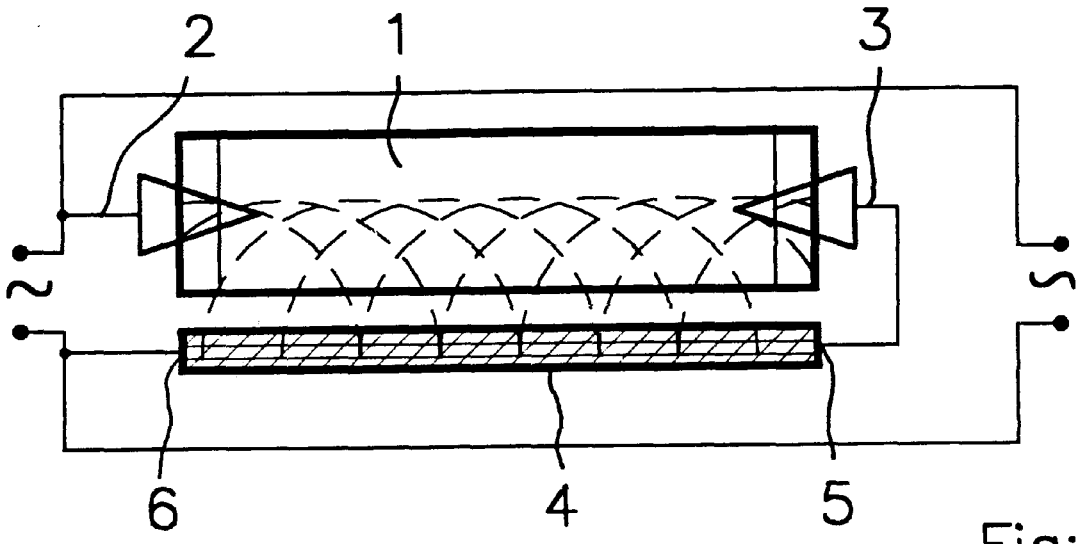
FIG. 1 is a general schematic view of the device according to the invention.

There is seen in FIG. 1 the diagram of an electric starting circuit for a gaseous discharge tube according to the invention.

It comprises a tube 1 supplied from a grid of alternating current and whose electrodes are indicated at 2 and 3. The alternating current supply advantageously contributes to avoiding darkening of the ends of the tubes due to the electrolysis effect and of improving the life of the tube.

It also comprises a member 4 made of loaded polymer, of such shape that it can be positioned along the tube 1 so as to constitute a frame serving for support and if desired as a reflector for the tube.

The ends of the member 4 are shown at 5 and 6, and when the circuit is closed, a voltage difference between the ends 6 and 5 of the member 4 is created by the resistance of the latter.

Produced by loaded polymer, the member 4 which permits instantaneous starting of the tube, has the characteristics of a resistance, no matter what the grid frequency, i.e., whether a low or high frequency.

The level of charge of the polymer is a function of the desired power characteristics and the acceptable temperature rise of the device.

The different shapes and forms possible for the member 4 optimize the thermal characteristics and the power of the device.

The end 5 of the member 4 is connected to the electrode 3 of the tube 1. The tube 1 is positioned adjacent the member 4, which permits the modification of the resistance of the external wall and modifies the distribution of the electrical field within the lamp. These modifications of the lines of electrical force, due to the member 4 lead to starting of the tube 1 which becomes conductive. The electrical circuit is closed when the electrode 2 of the tube 1 is connected to the power circuit. The position of the member 4 adjacent the tube 1 promotes an increase in brilliance of the latter. This acceleration of the starting constitutes a very interesting feature, in particular for domestic lighting. For tube constructions in which the temperature of the cold point of the tube becomes greater than 50° C., the overall efficiency of the system will be slightly decreased, but it must be noted that the decrease beyond 50° C. is substantially less rapid than the gain realized below the optimum temperature. The use of an amalgam permits moreover fitting the operation of the lamp to the most favorable temperature with regard to the compromise starting speed/efficiency.

In a first embodiment shown in FIG. 1, the device is particularly adapted for tubes of dimensions such that the electrodes will be fairly close. The low weight of the device and its reduced size permit its use in various lighting and decorative fields, interior and exterior.

Multiple possible uses of the device also result from the possibilities of connection of several successive tubes thanks to a plurality of assembly modes.

The role of the electrostatic effect remains, no matter what the size of the tubes. However, the greater the spacing between the electrodes of the tubes, the more it is necessary in order to overcome the insulating medium and in order to create an electrical discharge, to have high electrical voltage between the electrodes, at the same time as a reserve of electrical charges.

Figure 2:
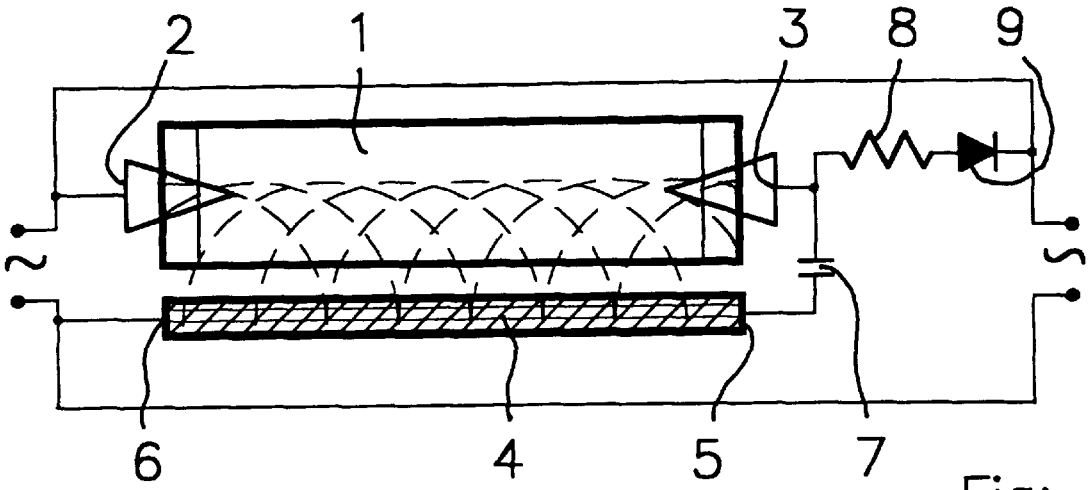
FIGS. 2, 3, 4 and 5 show embodiments of the device according to the invention as a function of the characteristics of the different tubes to be started.

To do this, a condenser 7, mounted in series with the member 4 and a diode 9, is continuously charged through a resistance 8. Shown in FIG. 2, when voltage is applied, the gas of the tube 1 is ionized, the tube becomes conductive, the condenser 7 discharges between the electrodes 3 and 2 of the tube 1, to effect the tube starting.

The member 4 and the condenser 7 then maintain the brilliance of the tube, the resistance 8 and the diode 9 being located practically outside the circuit because of the high impedance of the resistance 8.

Figure 3:
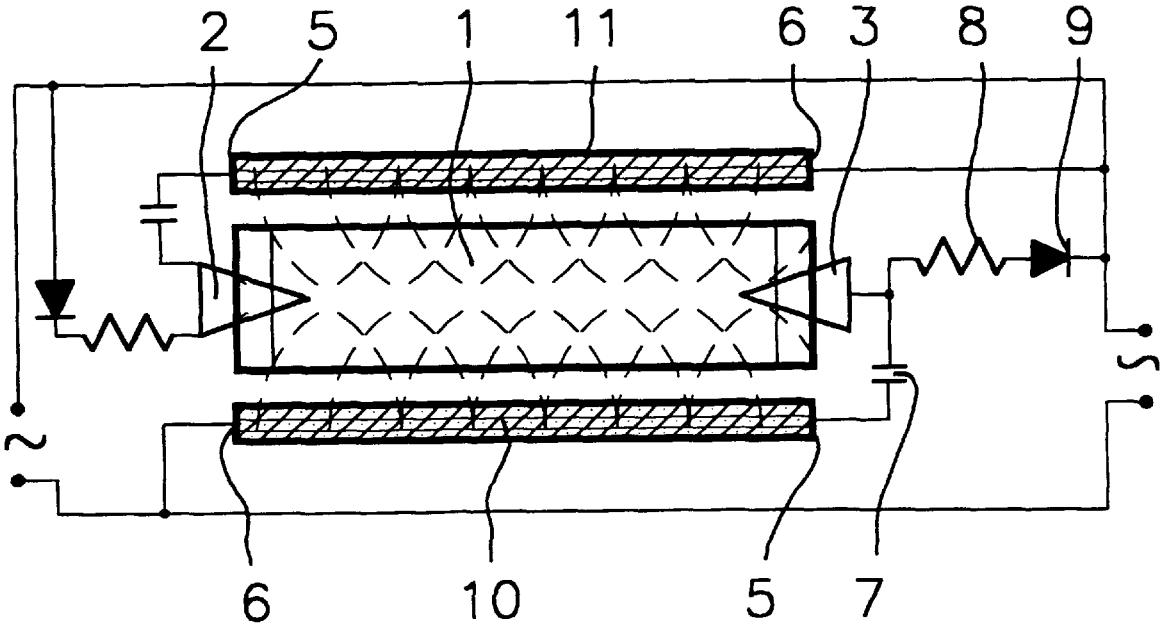

Preferably, this same circuit comprised by the condenser 7 and the resistance 8 and the diode 9 can be mounted on each electrode 2 and 3 of the tube 1 via members 10 and 11 constituting a doubling of the member 4. This mounting shown in FIG. 3 permits doubling the voltage favoring starting of the tube.

In the same way, for tubes having larger dimensions, there can be employed mountings that are power multipliers of the discharge, the member 4 conserving its characteristics and its role, as a function of the ratio between the proportions of load of the polymer and the characteristics of length, volume and power of the device.

Figure 4:
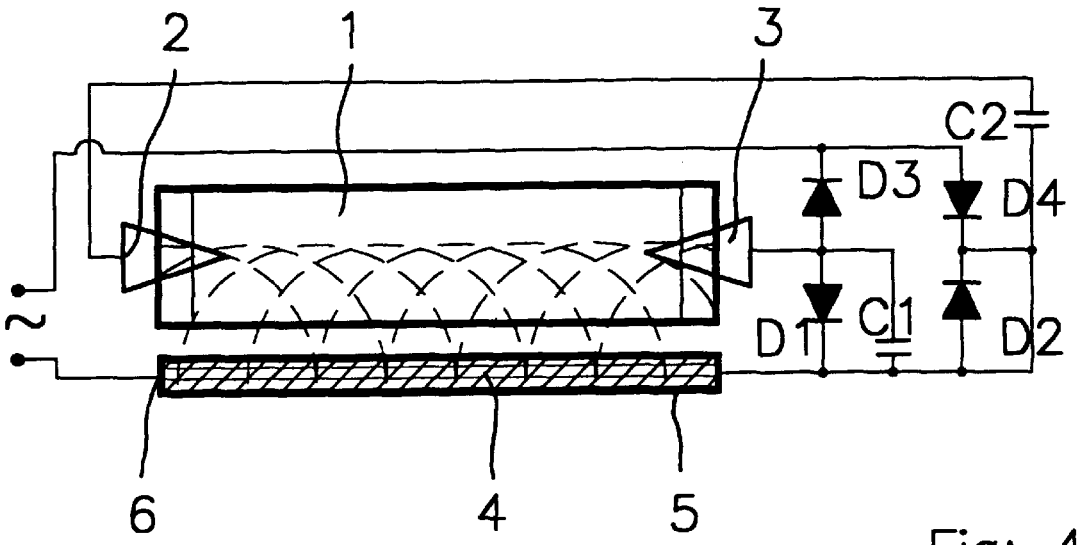

These known mountings are effected by means of diode bridges and are shown schematically in FIG. 4.

Figure 5:
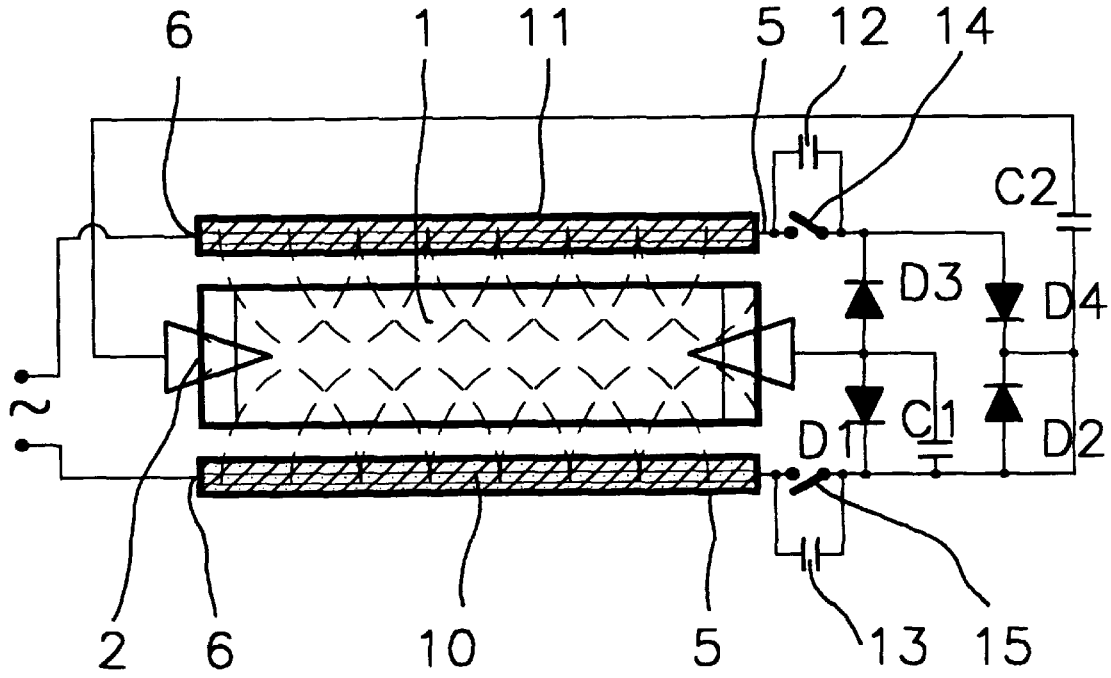

It can also be provided to include in the circuit, according to the diagram shown in FIG. 5, condensers 12 and 13 piloted by switches 14 and 15, so as to modify the brilliance of the tube.

As shown in FIG. 1, the present invention provides an integrated starter and regulator in which requires neither a condenser nor a resistance nor a diode. The invention permits using, with gaseous discharge tubes, intensity variers, controlled manually or by means of a clock and if desired by various sorts of detectors, luminous or sonic. There can also be obtained the variability of luminous intensity of the lighting source.

Further, according to FIGS. 4 and 5, the electrical circuits can be more complicated structures by providing a plurality of diodes D1, D2, D3 and D4 and of condensers C1 and C2.

REFERENCES

1. Fluorescent tube
2. Electrode of tube 1
3. Other electrode of tube 1
4. Member of loaded polymer
5. End of the member 4
6. Other end of the member 4
7. Condenser
8. Resistance
9. Diode
10. First member of loaded polymer
11. Second member of loaded polymer
12 and 13. Condensers
14 and 15. Switches
D1 to D4. Other diodes
C1 and C2. Other condensers

I claim:

1. A device to assist in starting and regulating a fluorescent tube, having two electrodes, each of the electrodes being located at one of the ends of the tube, said device comprising:

a member of loaded polymer, said member being located adjacent the tube and electrically connected to the two electrodes, wherein said member of loaded polymer serves as a ballast for the tube to aid in starting and regulating the correct operation of the tube.

2. The device of claim 1, further comprising:

a condenser and a diode-resistance assembly connected to one of the two electrodes.

3. The device of claim 2, wherein said loaded polymer comprises one of polyvinyl chloride, nylon with inclusions of metal, and carbon black.

4. The device of claim 2, wherein said loaded polymer comprises an ionized polymer.

5. The device of claim 4, wherein said ionized polymer is a polyacetylene.

6. The device of claim 1, wherein said loaded polymer comprises one of polyvinyl chloride and nylon with inclusions of metal or carbon black.

7. The device of claim 1, wherein said loaded polymer comprises an ionized polymer.

8. The device of claim 7, wherein said ionized polymer is a polyacetylene.

9. The device of claim 1, wherein said member of loaded polymer comprises a frame serving as a support and as a reflector for the tube.

10. A lamp comprising:

a fluorescent tube; and a starting-regulating circuit, comprising a loaded polymer member designed and adapted to aid in starting and regulating the operation of said tube, said starting-regulating circuit being positioned adjacent said tube and operatively connected to said tube.

11. The lamp of claim 10, wherein said loaded polymer member further comprises ions formed from one of sodium, iodine, and mercury.

12. A lamp comprising:

a fluorescent tube with two electrodes;

a starting-regulating circuit, operatively connected to said tube, comprising a loaded polymer member designed and adapted to aid in starting and regulating operation of said tube and positioned adjacent said tube, wherein said member of loaded polymer comprises a frame serving as a support and as a reflector for said tube.

13. The device of claim 12, further comprising:

a condenser and a diode-resistance assembly connected to one of said two electrodes.

14. The device of claim 12, wherein said loaded polymer comprises one of polyvinyl chloride and nylon with inclusions of metal or carbon black.

15. The device of claim 12, wherein said loaded polymer comprises an ionized polymer.

16. The device of claim 15, wherein said ionized polymer is a polyacetylene.

17. The lamp of claim 12, wherein said member of loaded polymer further comprises ions formed from one of sodium, iodine, and mercury.

* * * * *